US008272522B2

(12) United States Patent
Stull, Sr. et al.

(10) Patent No.: US 8,272,522 B2
(45) Date of Patent: Sep. 25, 2012

(54) BREAK-AWAY IMPACT-RESISTANT TIP

(75) Inventors: Gene Stull, Sr., Far Hills, NJ (US); Robert T. Auer, East Stroudsburg, PA (US)

(73) Assignee: Stull Technologies, Inc., Somerset, NJ (US)

( * ) Notice: Subject to any disclaimer, the term of this patent is extended or adjusted under 35 U.S.C. 154(b) by 1011 days.

(21) Appl. No.: 11/899,506

(22) Filed: Sep. 6, 2007

(65) Prior Publication Data

US 2009/0039083 A1 Feb. 12, 2009

Related U.S. Application Data

(60) Provisional application No. 60/964,168, filed on Aug. 8, 2007.

(51) Int. Cl.
*B65D 41/34* (2006.01)
*B65D 47/10* (2006.01)

(52) U.S. Cl. ..... 215/253; 215/48; 215/228; 220/266; 220/257.2; 222/541.6; 222/568

(58) Field of Classification Search ..... 215/48, 215/228, 253; 220/266; 222/541.1, 541.6, 222/541.9

See application file for complete search history.

(56) References Cited

U.S. PATENT DOCUMENTS

| | | | | |
|---|---|---|---|---|
| 3,460,724 | A | | 8/1969 | Chmela |
| 4,248,227 | A | | 2/1981 | Thomas |
| 4,566,613 | A | | 1/1986 | Anscomb |
| 4,688,703 | A | * | 8/1987 | Bayer ..... 222/541.8 |
| 5,221,029 | A | | 6/1993 | Stull |
| 5,255,804 | A | * | 10/1993 | Butterbrodt ..... 604/111 |
| D350,694 | S | | 9/1994 | Kovacic et al. |
| 5,361,947 | A | | 11/1994 | Lifshey |
| 5,788,100 | A | | 8/1998 | Sturk |
| D401,508 | S | | 11/1998 | Brown, III |
| 5,908,124 | A | | 6/1999 | Klauke et al. |
| D413,117 | S | | 8/1999 | Chintala et al. |
| 5,944,206 | A | | 8/1999 | Culter et al. |
| 6,068,148 | A | | 5/2000 | Weiler |
| 6,543,655 | B1 | | 4/2003 | de Laforcade |
| D532,295 | S | | 11/2006 | Stull |
| 7,431,529 | B1 | | 10/2008 | Rushe et al. |
| 2002/0170926 | A1 | | 11/2002 | Horner et al. |
| 2003/0127472 | A1 | | 7/2003 | Doherty et al. |
| 2006/0070999 | A1 | | 4/2006 | Stull |

* cited by examiner

*Primary Examiner* — Anthony Stashick
*Assistant Examiner* — James N Smalley
(74) *Attorney, Agent, or Firm* — Drinker Biddle & Reath LLP

(57) ABSTRACT

A closure for a container, the closure including a spout having a dispensing nozzle and a tip attached to the spout at a break-away junction. The break-away junction is recessed from the nozzle such that a user is protected from rough or jagged edges that may be created when the tip is broken away from the spout. The spout also has an orifice that is smaller than the dispensing nozzle for controlling the rate or amount of product dispensed from the container, the orifice remaining intact when the tip is broken away from the spout. The tip is sufficiently flexible to absorb an impact, such as from the container being dropped, but is sufficiently stiff that a user can fracture the break-away junction by applying sideways force to the tip. The closure may be attached to the container by a cap body or may be formed integrally with the container.

16 Claims, 12 Drawing Sheets

BREAK-AWAY IMPACT-RESISTANT TIP

RELATED APPLICATION

This application claims priority from U.S. Provisional Patent Application No. 60/964,168 filed Aug. 8, 2007, which is incorporated herein by reference in its entirety.

FIELD OF THE INVENTION

The present invention relates generally to container closures, and more particularly to a container closure having an impact resistant break-away tip that can be readily broken away by a user exerting sideways force.

BACKGROUND OF THE INVENTION

Containers are used to contain and dispense various products, including liquids, gels, and powders. Typically, a container includes an container closure with a spout having a dispensing nozzle sealed by a break-away nozzle tip. To prevent accidental discharge of product from the container during shipment, the nozzle tip is commonly joined to or molded into the nozzle such that the tip seals the nozzle until it is broken away at a break-away junction by a consumer when the product is to be dispensed.

However, a problem with a break-away nozzle tip is that it is prone to premature breakage if the container is accidentally dropped on the tip, or if the tip is otherwise subjected to an unintentional impact. The force of such impacts can be simulated in various ways, including by an industry-standard drop test. Another problem with a break-away nozzle tip is that, once broken away from the dispensing nozzle, it may leave the dispensing nozzle with a rough or jagged edge at the break-away junction. A rough or jagged nozzle edge can scratch or cut the skin of a user who is applying the product from the container directly to sensitive skin regions, such as the scalp.

An additional problem with a break-away nozzle tip is that the tip is usually designed so that the break-away junction, coincides with an orifice through which product will be dispensed, such that the orifice is created at the fractured junction. Such break-away tips are disclosed, for example, in U.S. Patent Application Publication No. 2006/0070999 A1, commonly assigned with the present application. As a result, it is difficult to control the size of the orifice because any deformation of the break-away junction also deforms the orifice, and thus it is difficult to accurately control the rate and amount of product that will be dispensed through the orifice.

Accordingly, it would be advantageous to provide a container closure having a break-away tip that is resistant to breakage when subjected to an accidental drop or other unintentional impact, but is still readily broken away by a consumer desiring to dispense the product from the container. Such a container closure would be capable of absorbing an impact without fracturing the break-away junction, but would allow a user to easily fracture the break-away junction by applying one or more of sideways force, twisting, and pulling.

It would be further advantageous to provide a container closure having a break-away tip that leaves the dispensing nozzle with a smooth, non-jagged outer edge that can be placed in direct contact with sensitive skin of a consumer without causing scratches or cuts to the skin.

It would be still further advantageous to provide a container closure having an orifice spaced apart from the break-away junction such that orifice remains intact and the size of the orifice remains fixed, regardless of any deformation that may occur at the fractured break-away junction.

SUMMARY OF THE INVENTION

The present invention provides a one-piece container closure having spout and a break-away tip for sealing a nozzle at an end of the spout through which product is to be dispensed. The tip is joined to the spout at a break-away junction and is capable of absorbing the impact of an industry-standard drop test and remaining in place without causing the break-away junction to fracture. The tip is also capable of being easily broken off by a typical consumer who desires to dispense product from a container onto which the closure is installed. Accordingly, the molded material for making the closure tip is flexible enough to absorb an impact but stiff enough to transmit a force applied by a user to the side of the tip to the break-away junction so as to cause the tip to separate from the closure, leaving the dispensing nozzle open at the end of the spout.

The present invention further provides a one-piece container closure having a break-away tip wherein the break-away junction is recessed from the dispensing nozzle at the end of the spout such than any rough or jagged edges at the fracture of the break-away junction will not contact the skin of a user when dispensing the product.

The present invention still further provides a one-piece container closure having an orifice in the spout spaced apart from the break-away junction such that the orifice is not deformed when the break-away tip is fractured away from the spout.

The closure is intended for single-use dispensing applications, where the tip is broken away and discarded. The closure is not intended to be resealed (unless a separate cap is included), because once the tip is broken away, the dispensing nozzle remains open. In particular, the closure can be used for dispensing products that have a limited life cycle or for which a predetermined amount of product is to be dispensed. In an example, the closure having a break-away tip can be used for dispensing hair products.

Other objects, advantages, and features of the present invention will become apparent to those skilled in the art upon reading the following detailed description, when considered in conjunction with the accompanying drawings briefly described below.

BRIEF DESCRIPTION OF THE DRAWINGS

For the purpose of illustrating the invention, the drawings show a form of the invention that is presently preferred. However, it should be understood that this invention is not limited to the precise arrangements and instrumentalities shown in the drawings.

DESCRIPTION OF THE INVENTION

Figure 1A:
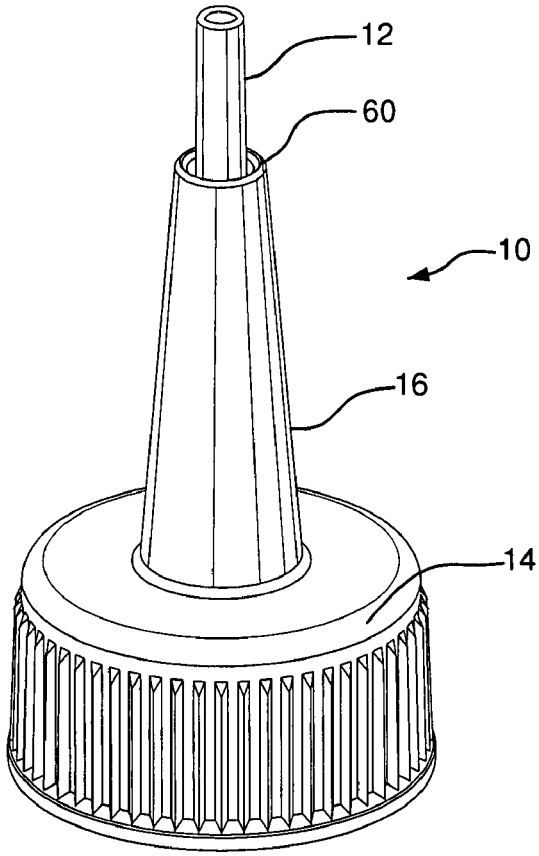
FIG. 1A is a perspective view of the container closure showing an embodiment of a break-away impact tip of the present invention.
Figure 1B:
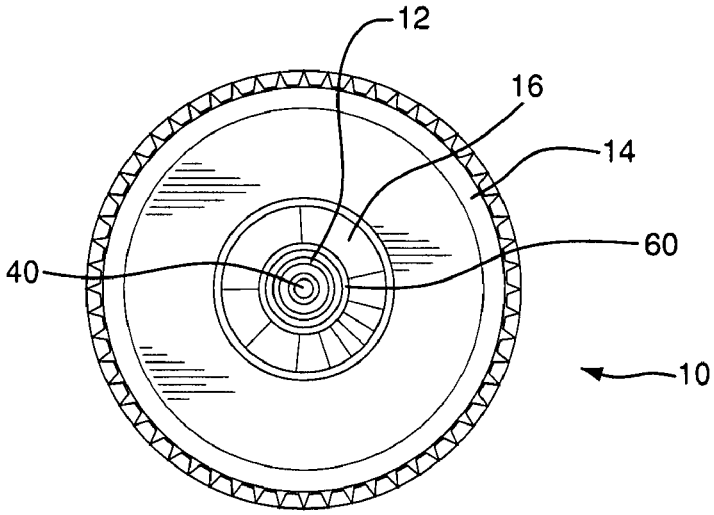
FIG. 1B is a top view of the container closure of FIG. 1A.

Referring to the drawings, where like numerals identify like elements, there is illustrated in FIGS. 1A to 1E a container closure 10 according to an exemplary embodiment of the invention. As shown particularly in FIGS. 1A and 1C, the container closure 10 includes cap body 14, a spout 16 extending outwardly from the cap body 14, and a tip 12 joined to the spout 16 at a break-away junction 18. The container closure 10 can be formed by injection molding as a one-piece construction, noting that different portions of the closure 10 can be molded from different materials having different properties, so that the relative stiffness or flexibility of the tip 12 can be adjusted to achieve the desired impact resistance without changing the performance characteristics of the rest of the closure 10. It is further contemplated that the container closure 10 can be formed integrally with a container such that the spout 16 extends outwardly from the container itself.

The cap body 14 can include any conventional mechanism for fastening to a container, such as threads or snap-on engagement. The spout 16 is preferably tapered away from the cap body 14 and terminates in a dispensing nozzle 60 having walls 66, a countersunk or recessed base 62, and a dispensing end 64. The dispensing end 64 forms an annulus around the countersunk base 62, and the tip 12 is attached to the spout 16 at the break-away junction 18 within the countersunk base 62.

The break-away junction 18 is defined by a section of thin walls 19 located within the countersunk base 62 of the dispensing nozzle 60, such that when the tip 12 is broken away from the spout 16, the fractured walls 19 of the break-away junction 18 are recessed from the end of the nozzle 60. As a result, after the tip 12 is broken away, the dispensing end 64 of the dispensing nozzle 60 is smooth and contains no sharp or exposed edges that could possible contact or scratch a user's skin when product is dispensed from the container.

Figure 1D:
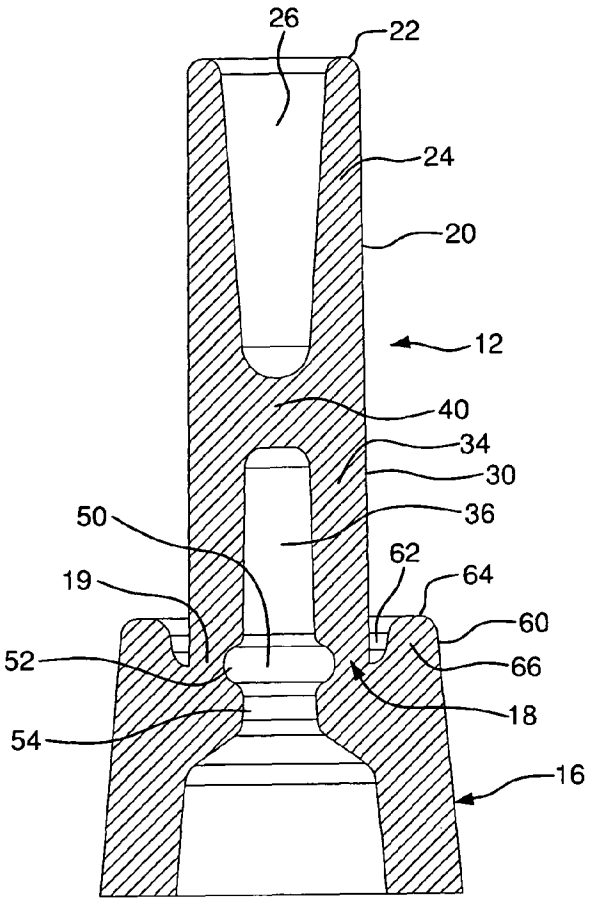
FIG. 1D is an enlarged partial cross-sectional view of the container closure of FIG. 1A showing the tip.
Figure 1C:
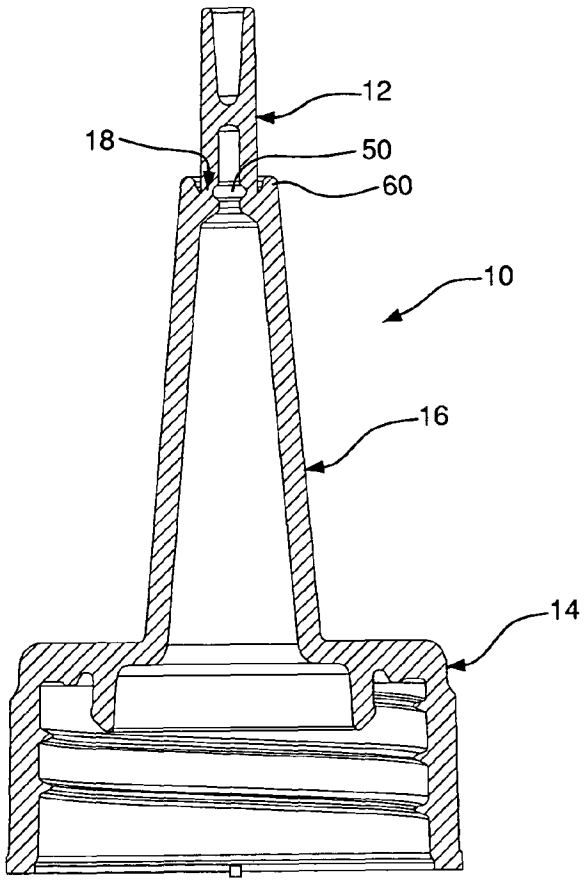
FIG. 1C is a cross-sectional view of the container closure of FIG. 1A

As shown in detail in FIG. 1D, the tip 12 comprises a top portion 20 and a bottom portion 30 joined at a plug stop 40. The bottom portion 30 extends from the break-away junction 18 outwardly to the plug stop 40, and the top portion 20 extends further outwardly from the plug stop 40 to an end 22. Walls 24 of the top portion 20 define an open cavity 26, the walls 24 preferably tapering from thicker at plug stop 40 to thinner at the end 22. The open cavity 26 results in the top portion 20 being more flexible than the bottom portion 30. The tapered shape of the walls 24 enables the top portion 20 to flex under the sudden impact of a drop test, absorbing the impact forces sufficiently so that the walls 19 of the break-away junction 18 remain intact. Walls 34 of the bottom portion 30 define a cavity 36 that opens onto a central break-away region 50.

The plug stop 40 reinforces the strength of the tip 12 at the junction between the top portion 20 and the bottom portion 30. The plug stop 40 is positioned in the tip 12 approximately at the midpoint thereof, and is located where a user is intended to push the tip 12 sideways in order to apply sufficient force to cause the tip 12 to fracture away from the spout 16 at the break-away junction 18. The stiffness imparted by the plug stop 40 prevents the walls 24, 34 of the tip 12 from collapsing or bending in on themselves when a user applies sideways force, for example with a finger or thumb, to break off the tip 12, allowing the user-applied force to be focused onto the break-away junction 18.

A medium density polyethylene has been found to perform well for construction of the tip 12, possessing both the flexibility to resist the impact forces of a drop test and the stiffness to transmit the break-away force applied by a user. A linear low polyethylene resin has also been used. In addition, harder or softer blends of material may be used depending factors including, but not limited to, user requirements and the size and/or geometry of the tip 12, the spout 16, and the break-away junction 18.

Figure 1E:
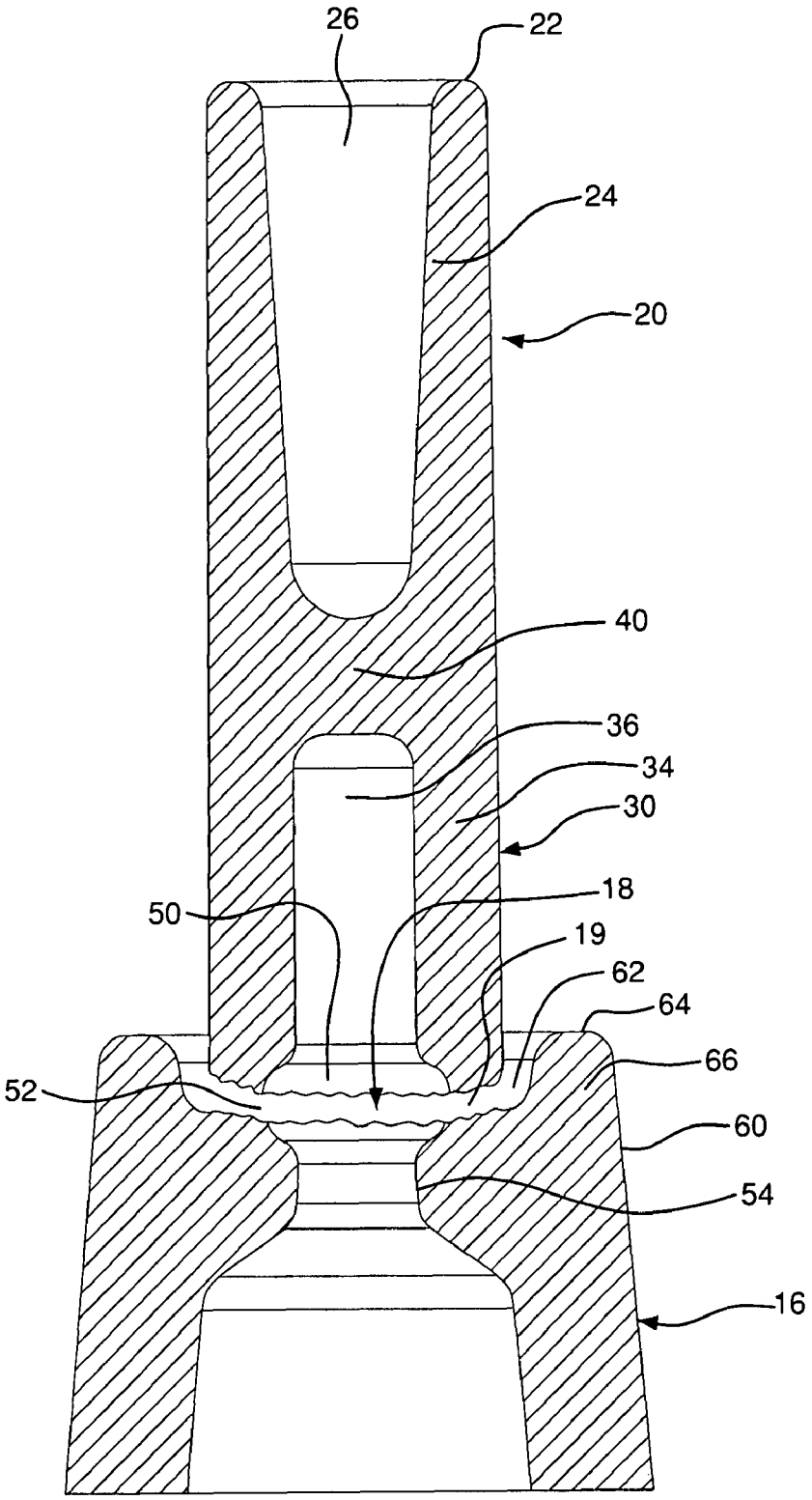
FIG. 1E is an enlarged partial cross-sectional view of the container closure of FIG. 1A showing the tip broken away from the spout.

In the illustrated embodiment, the break-away region 50 is defined by a bulged cavity bounded by the walls 19 of the break-away junction 18 and disposed between an orifice 54 at the top of the spout 16 and the cavity 36 in the bottom portion 30 of the tip 12. The break-away region 50 may be formed in the shape of a three-quarter ball or a bulging disk, and preferably has a diameter larger than both the orifice 54 and the cavity 36. The largest diameter portion of the break-away region 50 corresponds to the bottom of the countersunk base 62, so that the walls 19 are thinner than both the walls 34 of the bottom portion 30 of the tip 12 and the walls 66 of the spout 16 that form the orifice 54. Accordingly, when a sideways force is applied to the tip 12 at or near the location of the plug stop 40, the tip 12 breaks away from the spout 16 at the break-away junction 18, which shears off at the walls 19, as shown in FIG. 1E.

Once the tip 12 has been broken away at the break-away junction 18, a mouth 52 is formed through which product can be dispensed. The mouth 52 is recessed from the dispensing end 64 so that any rough edges created by the fracture of the walls 19 at break-away junction 18 are spaced apart from the dispensing end 64 of the dispensing nozzle 60 that will be in contact with the skin of a user. The mouth 52 is larger in diameter than the orifice 54, so that the orifice 54 can be sized to precisely and accurately meter the amount and rate of product that will be dispensed. The orifice 54 is also smaller than the nozzle 60. Because the orifice 54 is located within a thicker-walled section of the spout 16, the orifice 54 is unaffected by the fracture of the walls 19 at break-away junction 18 to form the mouth 52. The shape of the break-away region 50 and the thickness of the corresponding walls 19 at the break-away junction 18 are designed to ensure that the orifice 54 remains undamaged by the removal of the tip 12.

The bulged cavity-shaped break-away region 50 can be molded into the closure 10 by tooling that is snapped out of the molded piece as the mold is opened. The size of the cavity in the break-away region 50 can be varied to control the amount of sideways force that is required to break off the tip 12 by fracturing the walls 19 of the break-away junction 18. The remainder of the closure 10 is formed by mold tooling that opens and closes along the length of the closure 10, rather than from the sides of the closure 10. As a result, the recessed or countersunk base 62 can readily be formed without creating any longitudinal seams that impair the visual appearance of the closure 10. Rather, the seam is preferably disposed along the dispensing nozzle 60 to facilitate formation of the dispensing end 64 and the recessed base 62.

Referring to FIGS. 2A to 2E, a container closure 110 is illustrated according to another exemplary embodiment of the invention. As shown particularly in FIGS. 2A and 2D, the container closure 110 includes cap body 114, a spout 116 extending outwardly from the cap body 114, and a tip 112 joined to the spout 116 at a break-away junction 118. The break-away junction 118 is located within a countersunk base 162 of a dispensing nozzle 160, such that when the tip 112 is broken away from the spout 116, the fractured break-away junction 118 is recessed from the nozzle 160. As a result, after the tip 112 is broken away, the dispensing end 164 of the dispensing nozzle 160 is smooth and contains no sharp or exposed edges that could possible contact or scratch a user's skin when product is dispensed from the container.

Figure 2A:
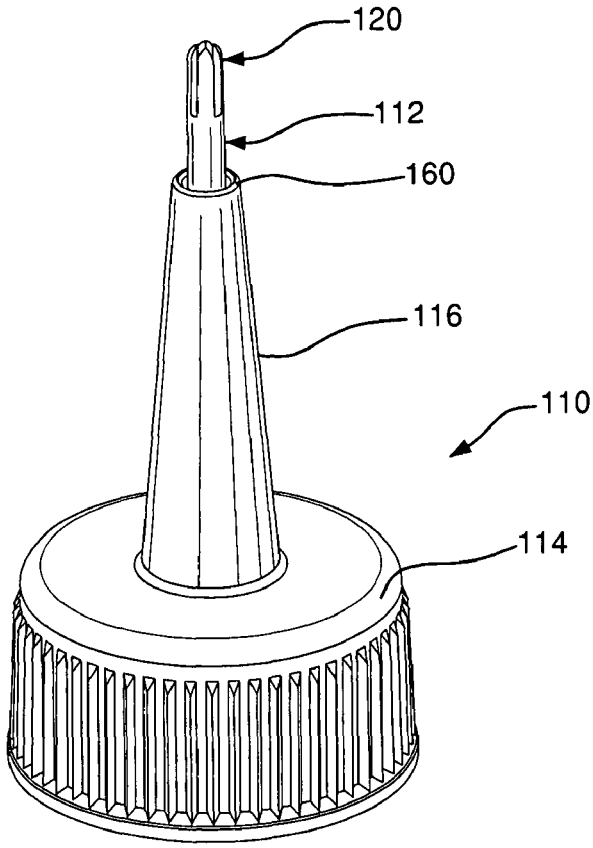
FIG. 2A is a perspective view of the container closure showing an embodiment of a break-away impact tip of the present invention.
Figure 2B:
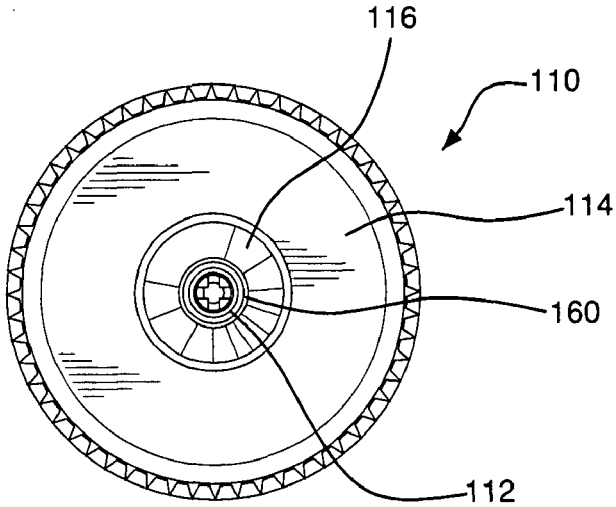
FIG. 2B is a top view of the container closure of FIG. 2A.
Figure 2C:
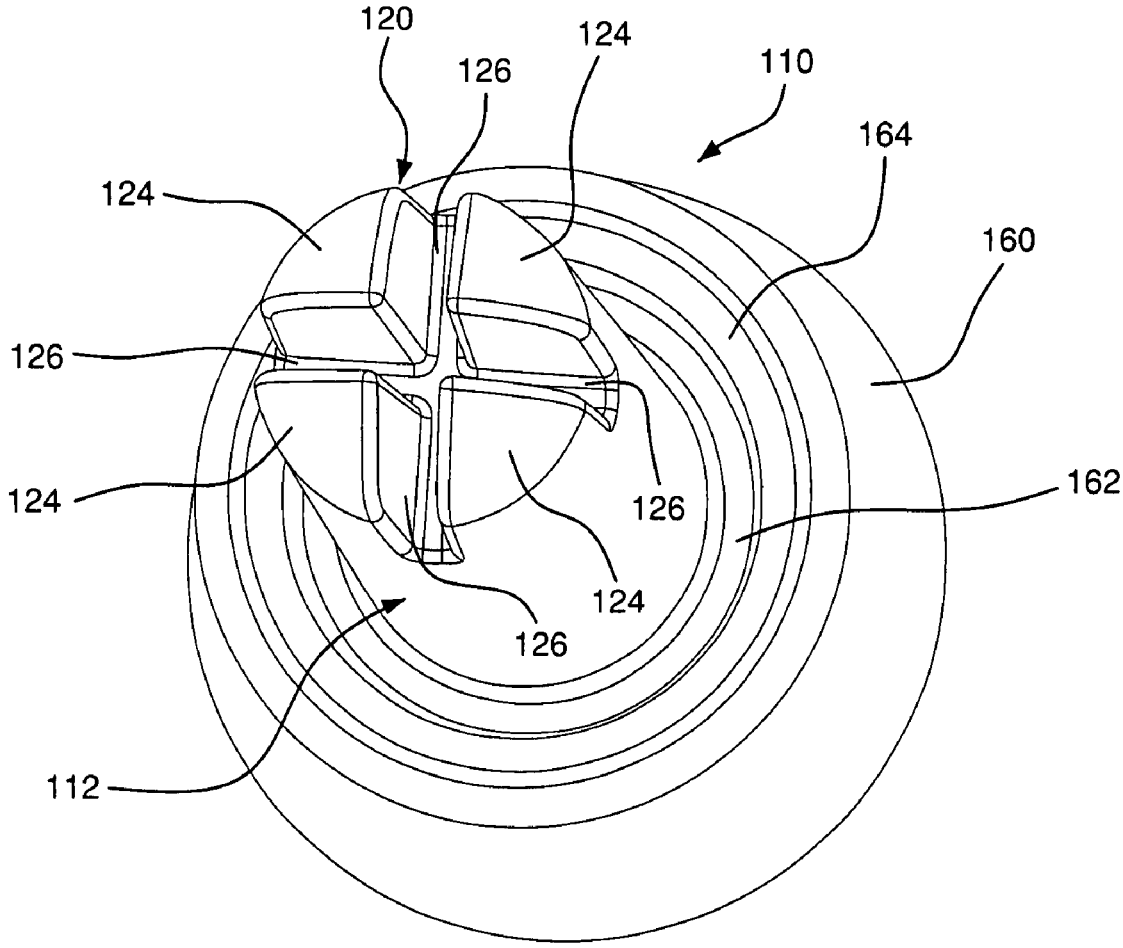
FIG. 2C is an enlarged partial perspective view of the tip portion of the container closure of FIG. 2A.
Figure 2E:
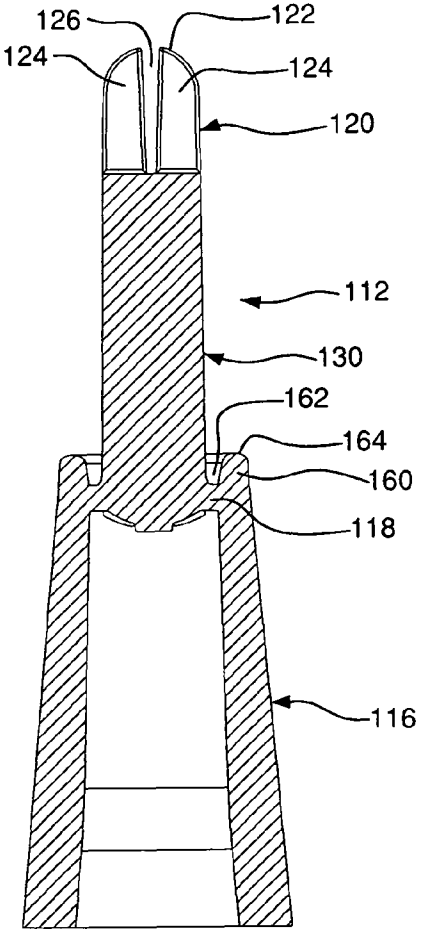
FIG. 2E is an enlarged partial cross-sectional view of the container closure of FIG. 2A showing the tip.
Figure 2D:
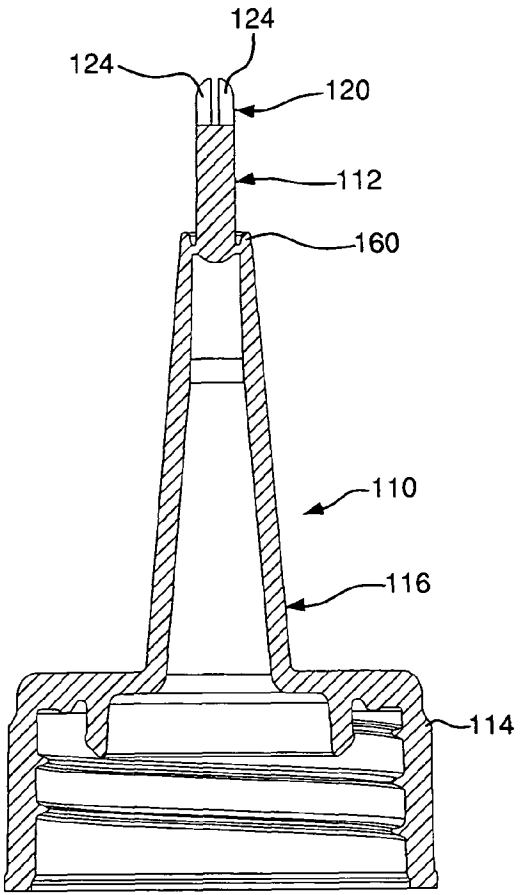
FIG. 2D is a cross-sectional view of the container closure of FIG. 2A

As shown in detail in FIG. 2E, the tip 112 comprises a top portion 120 and a bottom portion 130. The bottom portion 130 is solid and extends from the break-away junction 118 outwardly to the top portion 120, and the top portion 120 extends further outwardly from the bottom portion 130 to an end 122. The top portion 120 includes a plurality of longitudinal fingers 124 defined by interposed slots 126. The fingers 124 can be solid or hollow, and can be varied in length and/or thickness, in order to adjust their flexibility. The fingers 124 are sufficiently stiff to absorb the force of impact from a standard drop test, but are also sufficiently flexible not to transmit enough force to the bottom portion 130 of the tip 112 to fracture the break-away junction 118. The bottom portion 130 is preferably solid and is sufficiently stiff such that a user can fracture the break-away junction 118 by exerting sideways force at any point along the bottom portion 130.

Referring to FIGS. 3A to 3E, a container closure 210 is illustrated according to another exemplary embodiment of the invention. As shown particularly in FIGS. 3A and 3D, the container closure 210 includes cap body 214, a spout 216 extending outwardly from the cap body 214, and a tip 212 joined to the spout 216 at a break-away junction 218. Similarly to other embodiments of the invention, the break-away junction 218 is located within a countersunk base 262 of a dispensing nozzle 260, such that when the tip 212 is broken away from the spout 216, the fractured break-away junction 218 is recessed from the nozzle 260.

Figure 3A:
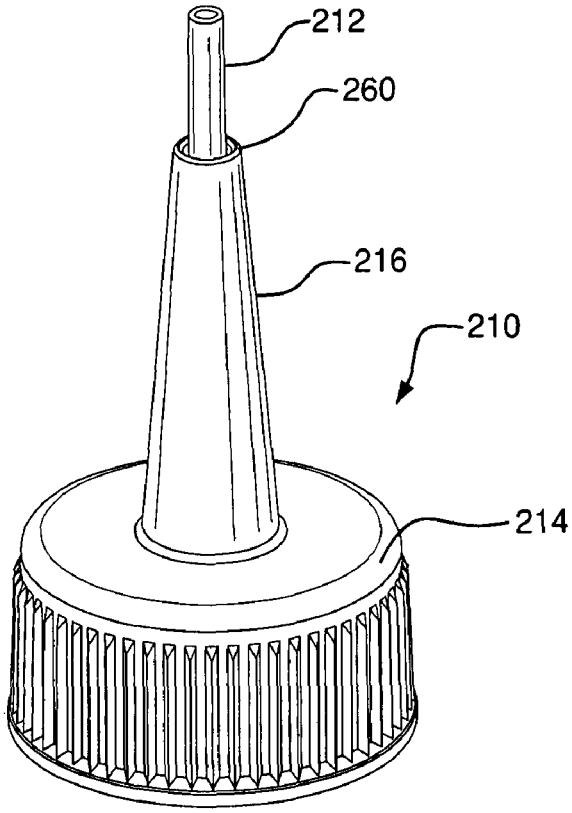
FIG. 3A is a perspective view of the container closure showing an embodiment of a break-away impact tip of the present invention.
Figure 3B:
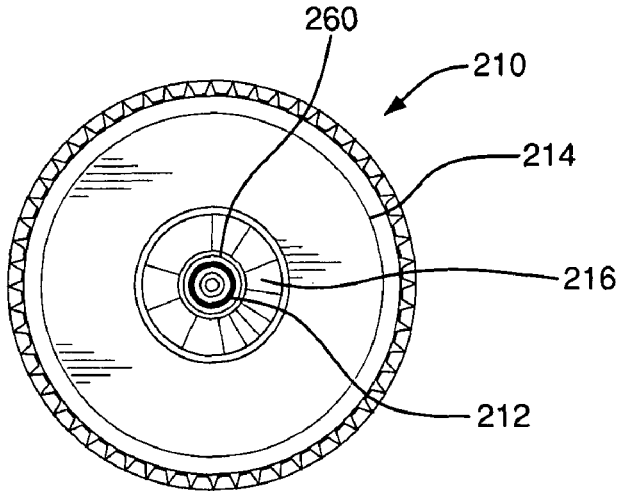
FIG. 3B is a top view of the container closure of FIG. 3A.
Figure 3C:
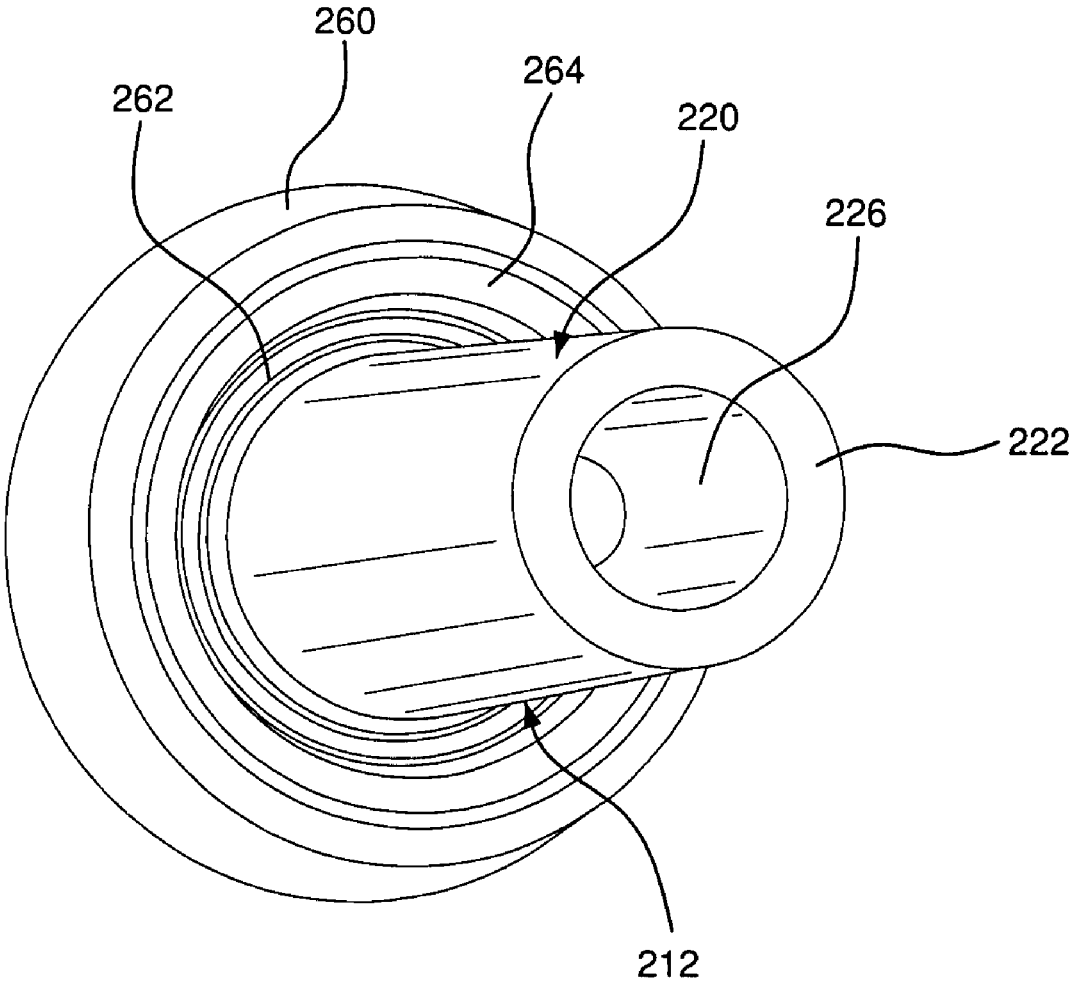
FIG. 3C is an enlarged partial perspective view of the tip portion of the container closure of FIG. 3A.
Figure 3E:
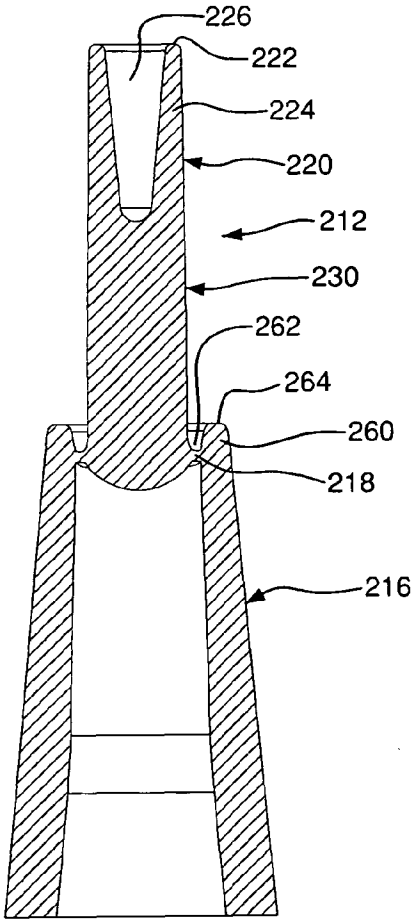
FIG. 3E is an enlarged partial cross-sectional view of the container closure of FIG. 3A showing the tip.
Figure 3D:
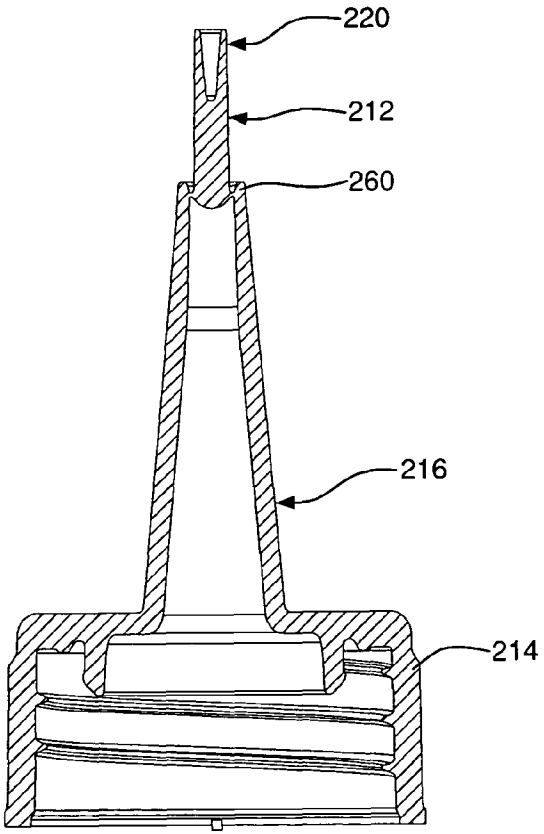
FIG. 3D is a cross-sectional view of the container closure of FIG. 3A
Figure 4B:
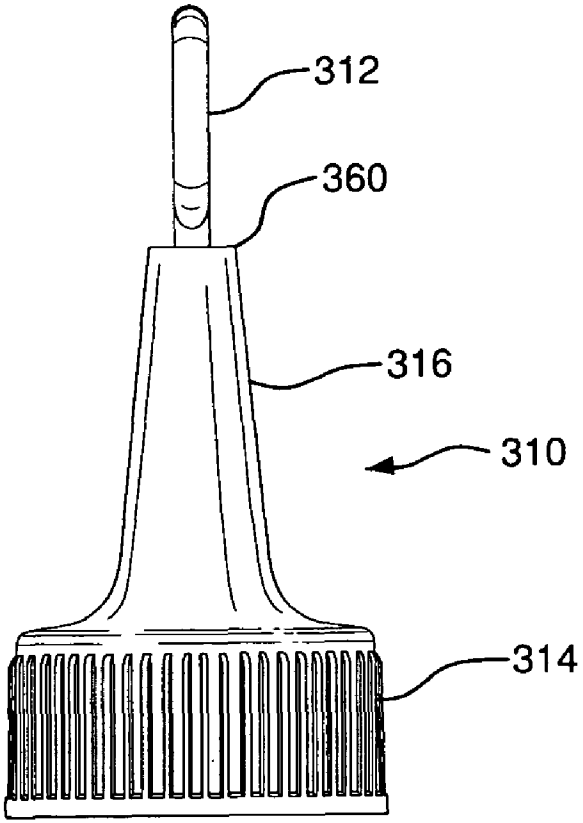
FIG. 4B is a side view of the container closure of FIG. 4A.
Figure 4A:
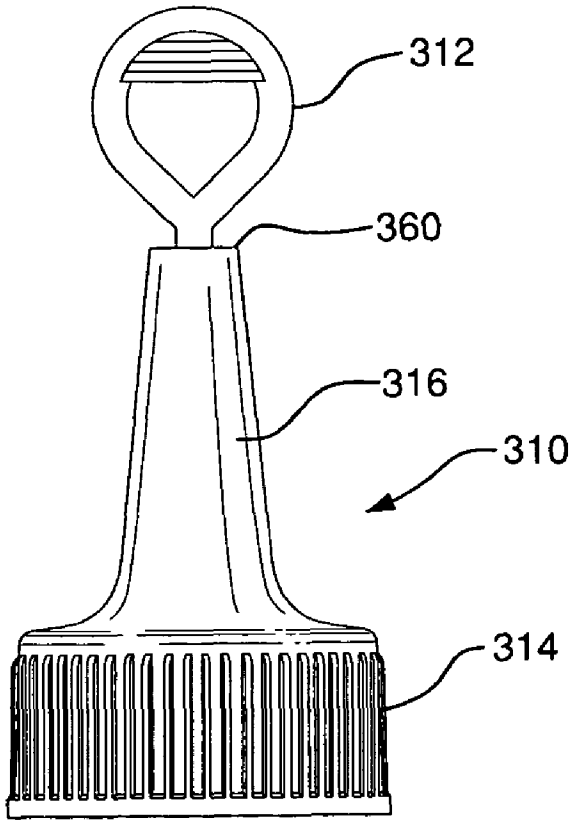
FIG. 4A is a front view of a container closure showing an embodiment of a break-away impact tip of the present invention.
Figure 4C:
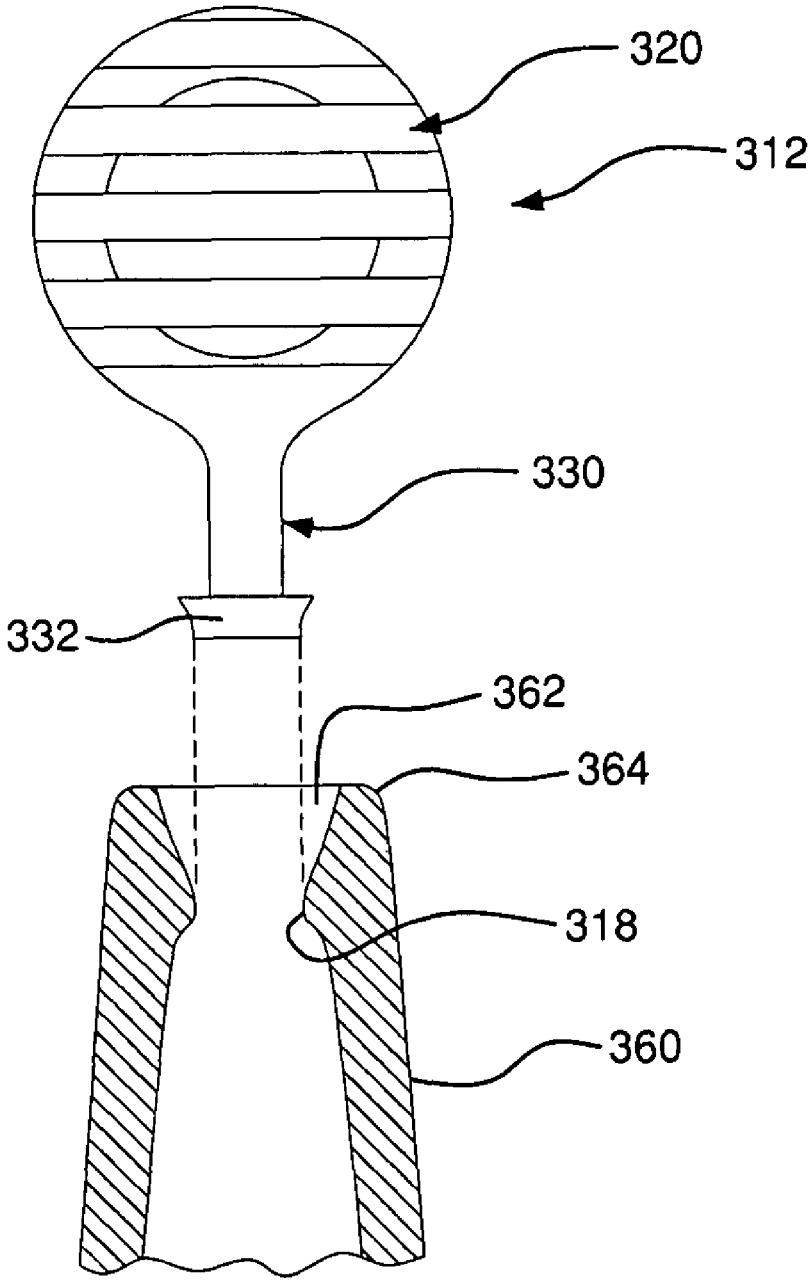
FIG. 4C is a partial front view of a container closure similar to the container closure of FIG. 4A, having a differently ornamented tip and showing the tip broken away from the spout.
Figure 4D:
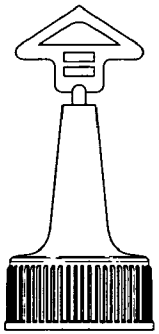
FIGS. 4D-4I are front views of a container closure similar to the container closure of FIG. 4A, having differently ornamented tips.
Figure 4E:
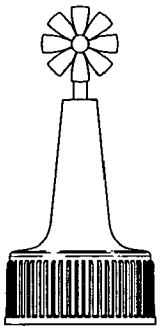
Figure 4F:
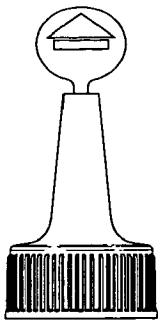
Figure 4G:
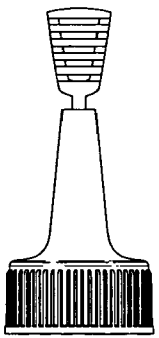
Figure 4H:
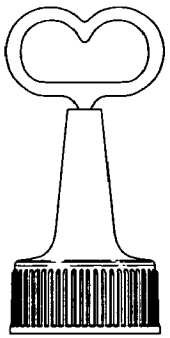
Figure 4I:
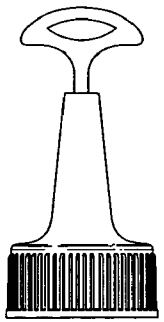

As shown in detail in FIG. 3E, the tip 212 comprises a top portion 220 and a bottom portion 230. The bottom portion 230 is solid and extends from the break-away junction 218 outwardly to the top portion 220, and the top portion 220 extends further outwardly from the bottom portion 230 to an end 222. Walls 224 of the top portion 220 define a cavity 226, the walls 224 tapering from thicker at the junction with the bottom portion 230 to thinner at the end 222. The tapered shape of the walls 224 enables the top portion 220 to flex under the sudden impact of a drop test, absorbing the force sufficiently so that the break-away 218 remains intact. The bottom portion 230 is preferably solid and is sufficiently stiff such that a user can fracture the break-away junction 218 by exerting sideways force at any point along the bottom portion 230.

Referring to FIGS. 4A to 4I, a container closure is illustrated according to another embodiment of the invention. As shown particularly in FIGS. 4A to 4C, the container closure 310 includes a cap body 314, a spout 316 extending outwardly from the cap body 314, and a tip 312 joined to the spout 316 at a break-away junction 318. Similarly to other embodiments of the invention, the break-away junction 318 is located within a countersunk base 362 of a dispensing nozzle 360, such that when the tip 312 is broken away from the spout 316, the fractured break-away junction 318 is recessed from the nozzle 360.

The tip 312 comprises a top portion 320 and a bottom portion 330. The bottom portion 330 includes a plug 332 disposed at the break-away junction 318 and extends outwardly therefrom to the top portion 320. The bottom portion 330 is sufficiently flexible to absorb the force of impact of a drop test or other impact, but is still sufficiently strong to enable a user to fracture the break-away junction 318 and remove the tip 312 by grasping and pulling or twisting the top portion 320. The tip portion 320 is preferably generally flat, being relatively thin in one direction and relatively thicker in a perpendicular direction, thus enabling the tip portion 320 to flex and assist the bottom portion 330 in deflecting and absorbing an impact without fracturing the break-away junction 318. The top portion can be formed to display a variety of attractive features while still retaining its functional advantages, as illustrated by the exemplary designs of FIGS. 4D to 4I.

The foregoing describes the invention in terms of embodiments foreseen by the inventor for which an enabling description was available, notwithstanding that insubstantial modifications of the invention, not presently foreseen, may nonetheless represent equivalents thereto.

The invention claimed is:

1. A container closure comprising:

a cap body for attaching the closure to a container;

a spout extending outwardly from the cap body to a nozzle; and a tip integrally molded with the spout at a break-away junction so as to form an integral piece therewith, the break-away junction being recessed from the nozzle, the tip extending outwardly from the nozzle to an end;

wherein the tip includes a top portion and a bottom portion integrally molded in one piece, the top portion including a cavity that is open at the end of the tip such that the top portion is more flexible than the bottom portion.

2. The container closure of claim 1, wherein the cavity in the top portion of the tip comprises a plurality slots defined by interposed fingers.

3. The container closure of claim 2, wherein the fingers are hollow.

4. The container closure of claim 2, wherein the fingers are solid.

5. The container closure of claim 1, wherein the bottom portion of the tip comprises walls defining a cavity.

6. The container closure of claim 1, wherein the bottom portion of the tip is solid.

7. The container closure of claim 1, wherein the spout comprises an orifice smaller than the nozzle, and wherein the break-away junction is defined by a thin-walled section located between the orifice and the nozzle.

8. The container closure of claim 7, wherein the orifice remains intact when the break-away junction is fractured to form a mouth that is larger than the orifice.

9. A container closure comprising:

a cap body for attaching the closure to a container;

a spout extending outwardly from the cap body to a nozzle; and a tip integrally molded with the spout at a break-away junction so as to form an integral piece therewith, the tip extending outwardly from the nozzle to an end and including a top portion and a bottom portion integrally molded in one piece, the top portion including a cavity that is open at the end of the tip such that the top portion is more flexible than the bottom portion;

wherein the spout comprises an orifice smaller than the nozzle, the orifice remaining intact when the break-away junction is fractured to form a mouth that is larger than the orifice.

10. The container closure of claim 9, wherein the break-away junction is recessed from the nozzle, the break-away junction being defined by a thin-walled section disposed between the nozzle and the orifice.

11. The container closure of claim 10, wherein the cavity in the top portion of the tip comprises a plurality slots defined by interposed fingers.

12. The container closure of claim 10, wherein the bottom portion of the tip comprises walls defining a cavity.

13. The container closure of claim 10, wherein the bottom portion of the tip is solid.

14. A container comprising:

a spout having a dispensing nozzle;

a tip integrally molded with the spout at a break-away junction recessed from the nozzle so as to form an integral piece with the spout, the tip extending outwardly from the nozzle to an end and including a top portion and a bottom portion integrally molded in one piece, the top portion including a cavity that is open at the end of the tip such that the top portion is more flexible than the bottom portion; and an orifice within the spout, the orifice being smaller than the nozzle, the break-away junction being disposed between the orifice and the nozzle, such that the orifice remains intact when the tip is broken away from the spout at the break-away junction.

15. The container closure of claim 1, wherein the tip further comprises a solid plug stop joining the top portion and the bottom portion of the tip, the cavity in the top portion having walls extending away from the plug stop to the open end of the cavity in the top portion opposite the plug stop, the bottom portion having walls extending away from the plug stop and defining a cavity opening into the spout.

16. The container closure of claim 9, wherein the tip further comprises a solid plug stop joining the top portion and the bottom portion of the tip, the cavity in the top portion having walls extending away from the plug stop to the open end of the cavity in the top portion opposite the plug stop, the bottom portion having walls extending away from the plug stop and defining a cavity opening into the spout.

* * * * *